United States Patent [19]

Rousset et al.

[11] Patent Number: 4,949,988

[45] Date of Patent: Aug. 21, 1990

[54] CROSS-COUNTRY SKI BOOT AND BINDING

[75] Inventors: Didier Rousset, Lescheraines; Marc Provence, Annecy Le Vieux; Josiane Dunand, Cran Gevrier, all of France

[73] Assignee: Salomon S.A., Annecy Cedex, France

[21] Appl. No.: 141,846

[22] Filed: Jan. 11, 1988

[30] Foreign Application Priority Data

Jan. 12, 1987 [FR] France ..... 87 00214

[51] Int. Cl.[5] ..... A63C 9/10

[52] U.S. Cl. ..... 280/615; 280/631

[58] Field of Search ..... 280/611, 614, 615, 626, 280/623, 631, 632

[56] References Cited

U.S. PATENT DOCUMENTS

| | | | |
|---|---|---|---|
| 4,330,949 | 5/1982 | Kubelka et al. | 280/615 X |
| 4,382,611 | 5/1983 | Salomon | 280/615 |
| 4,496,169 | 1/1985 | Salomon et al. | 280/632 |
| 4,533,154 | 8/1985 | Bernard et al. | 280/615 |
| 4,682,785 | 7/1987 | Jungkind | 280/615 |
| 4,743,042 | 5/1988 | Jarvinen | 280/631 |

FOREIGN PATENT DOCUMENTS

| | | | |
|---|---|---|---|
| 0016750 | 3/1980 | European Pat. Off. . | |
| 0176952 | 9/1985 | European Pat. Off. . | |
| 3405861 | 6/1985 | Fed. Rep. of Germany | 280/615 |
| 3426856 | 1/1986 | Fed. Rep. of Germany . | |
| 381644 | 11/1986 | Fed. Rep. of Germany . | |
| 383283 | 6/1987 | Fed. Rep. of Germany . | |
| 3707116 | 9/1987 | Fed. Rep. of Germany | 280/615 |
| 2582226 | 11/1986 | France | 280/615 |
| 2606657 | 5/1988 | France . | |
| 86/15944 | 12/1988 | France . | |
| 8503643 | 8/1985 | World Int. Prop. O. . | |

*Primary Examiner*—Charles A. Marmor
*Assistant Examiner*—Tamara L. Finlay
*Attorney, Agent, or Firm*—Sandler, Greenblum & Bernstein

[57] ABSTRACT

A cross-country ski binding member for releasably attaching the toe of a boot member to a ski includes cam elements on the members cooperable during downward movement of the boot member relative to the binding member in a direction perpendicular to the axis of the ski for effecting forward displacement of the boot member relative to the binding member until the sole of the boot member seats on the ski. A movable stirrup on the binding member is resiliently biased to a neutral position. Mutual engagement elements are provided on the stirrup and on the boot member. During cooperation of the cam elements, the engagement elements engage for affecting resilient displacement of the stirrup from its neutral position during initial forward displacement of the boot member. During final displacement of the boot member, the stirrup is resiliently displaced towards its neutral position and serves to retain the boot member to the ski. Finally, a connector pin is provided on one of the members, and a receiver is provided on the other of the members for pivotally receiving said connecting pin and effecting a pivotal connection between the members while the boot member is retain to the ski.

35 Claims, 5 Drawing Sheets

CROSS-COUNTRY SKI BOOT AND BINDING

TECHNICAL FIELD

The invention relates to a cross-country ski boot and binding.

BACKGROUND ART

French Patent Application Nos. 86/15944 and 86/15945 filed Nov. 17, 1986, disclose a cross-country ski boot and binding in which a front zone section on the boot cooperates with a stirrup journalled on the ski for pivotal movement about a first axis, and resiliently biased in a predetermined direction. The stirrup retains the boot to the binding when the sole of the boot rests flat on the ski. The toe of the boot is attached to the ski by the engagement of at least one pin on the toe with at least one homologous notch in either the stirrup or the ski. The notch opens in the direction of the ski and is situated on the same side as the first axis in relation to the toe of the boot. Alternatively, at least one notch in the toe of the boot cooperates with at least one homologous pin on the stirrup or on the ski, the last-mentioned notch opening towards the ski and situated on the same side as the first axis in relation to the toe of the boot. This arrangement defines a journalling of the boot about a second axis either parallel to the first axis, or merged with it.

The front zone of the boot and stirrup are in mutual contact between the two axes respectively on a surface facing the second axis, and on support means facing the second axis and supported on said surface in the predetermined direction. The support means are susceptible to disengaging said surface by rotation of the stirrup in a direction reverse to the predetermined direction.

The resilient bias of the stirrup urging rotation in the predetermined direction around its journalling axis on the ski, guarantees both retention of the boot to the ski by the stirrup, as well as supplying a resilient bias to the boot toward the position in which it rests flat on the ski in response to extentive movement of the boot during cross-country skiing.

The two patent applications mentioned above further describe a way to attach a boot to a ski by using a ski pole to impart rotation to the stirrup in a direction opposite to the predetermined direction. Such rotation of the stirrup by a ski pole effects a mutual engagement of the pin in the notch in response to downward movement of the boot relative to the ski. When the ski pole releases the stirrup, the resilient bias on the stirrup effects rotation of the latter into engagement with the boot thereby securing the same to the ski.

Such a way to attach the boot to a ski is technically satisfactory, but it has the drawback of being constraining to the skier who must apply his ski pole to the stirrup in order to rotate the stirrup against its resilient bias. It is therefore an object of the present invention to provide a new and improved cross-country ski boot and binding which overcomes the drawbacks of the prior art.

BRIEF DESCRIPTION OF THE INVENTION

According to the present invention, a cross-country ski binding member for releasably attaching the toe of a boot member to a ski having a longitudinal axis, comprises cam means on said members cooperable, during downward movement of the boot member relative to the binding member in a direction perpendicular to said axis, to effect forward displacement of said boot member relative to the binding member until the sole of said boot member seats on said ski. A stirrup on said binding is movably mounted thereon and resiliently biased towards a neutral position. Mutual engagement means on said stirrup and on said boot member are engageable during cooperation of said cam means for effecting resilient movement of said stirrup away from its neutral position during forward displacement of said boot member. During final displacement of the boot member to its position seated on the ski, the stirrup moves towards its neutral position and thereafter retains said boot member to said ski. A connector pin on one of said members is positioned transversely to said axis when said stirrup retains said boot member to said ski; and a receiver on the other of said members pivotably receives said connector pin and effects a pivotal connection between the members while said boot member is retained to said ski.

With this construction, the downward movement of the foot of the user to insert the boot into the binding causes the cam means to cooperate such that the boot moves simultaneously forwardly and downwardly causing the mutual engagement means to move the stirrup out of the way during initial forward movement of the boot. During final movement of the boot to a position where the sole rests on the ski, the resilient means moves the stirrup into a position in which the latter retains the boot to the binding. This movement of the stirrup occurs automatically in response to insertion of the boot into the binding.

To provide for the forward displacement of the boot during its downward movement, the cam means may include a projection on said binding member having an inclined ramp. The cam means on the boot member may include a recess in the sole of said boot member having a rear surface inclined relative to the longitudinal axis of the ski when the boot member is seated thereon, the inclination of the front surface of said ramp matching the rear surface of said recess.

The stirrup may be mounted on said binding member for pivotal movement about a pivot axis transverse to the longitudinal axis of the ski, and may be biased in a rearward direction along the axis of said ski. Preferably, said stirrup includes a pair of spaced arms, each arm having one end pivotal about said pivot axis, and a transverse bar interconnecting the respective other ends of said arms. Manual pressure on the transverse bar using, for example, a ski pole, pivots said stirrup against its resilient bias to release said boot member from said ski.

The binding member may include a central rib elongated in the direction of the longitudinal axis of the ski, and a shaft passing through said rib in a direction transverse to the longitudinal axis of the ski and defining said pivotal axis. One end of each arm may be pivotally mounted on the axial end of said shaft. In some embodiments of the invention, the engagement means on said stirrup includes a transverse rod extending between said arms, and said engagement means on said boot member includes a front projection on the toe of said boot which is engageable by the rod during initial forward placement of the boot member. The front projection may also include an upper surface that is inclined relative to the longitudinal axis of the ski when the boot member is seated on the ski, said upper surface being engageable by said rod during said final forward displacement of said boot member and serving to retain the boot to the ski.

In some of the embodiments, the connector pin is mounted on the binding member, and the receiver for this pin is on the boot member. The connector pin may extend between the arms of the stirrup, and the receiver may be a matching notch in a projection on the toe of said boot member. On the other hand, the connector pin may be mounted on said boot member and the receiver on the binding member. In a modification, the connector pin constitutes said cam means on said boot member. When the binding member includes a rib elongated in the direction of the longitudinal axis of the ski, a ramp may project upwardly from said rib. The ramp has a front surface inclined relative to the longitudinal axis of said ski and constituting the cam means on said binding member. In one modification of this embodiment, the receiver may be constituted by an upwardly opening notch in the rib. In another embodiment of the invention, the mutual engagement means on the boot member is the connector pin; and the receiver may include a notch in at least one of said arms of the stirrup.

The cross-country ski binding member of the present invention may also include a rib elongated in the direction of the longitudinal axis of the ski, and the connector pin may be mounted in the rib and extend in a direction transverse to the longitudinal axis of the ski. In such case, a notch in the boot member may constitute the receiver for the connector pin. A shaft may pass through the rib in a direction transverse to the longitudinal axis of the ski thus defining the pivotal axis of the stirrup. In such case, one end of each arm of the stirrup is pivotally mounted on an axial end of the shaft.

BRIEF DESCRIPTION OF DRAWINGS

Embodiments of the present invention are shown in the accompanying drawings wherein.

DETAILED DESCRIPTION OF PREFERRED EMBODIMENTS

Figure 9:
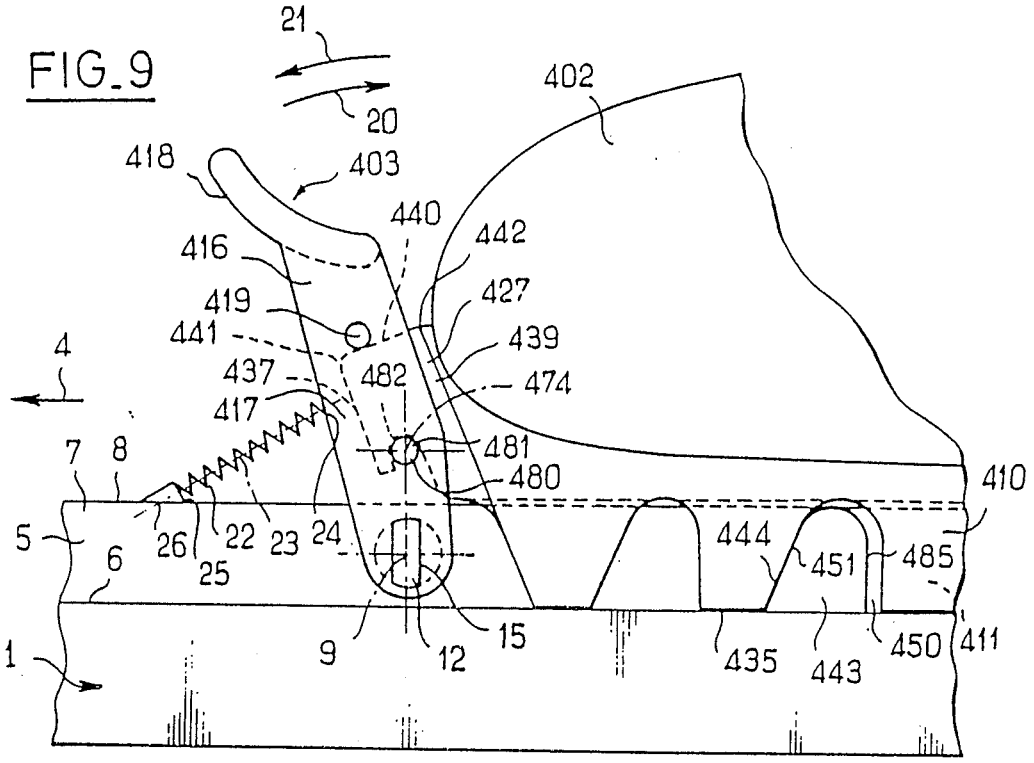
FIG. 9 is a view similar to FIG. 1 but showing a fifth embodiment of the present invention.
Figure 10:
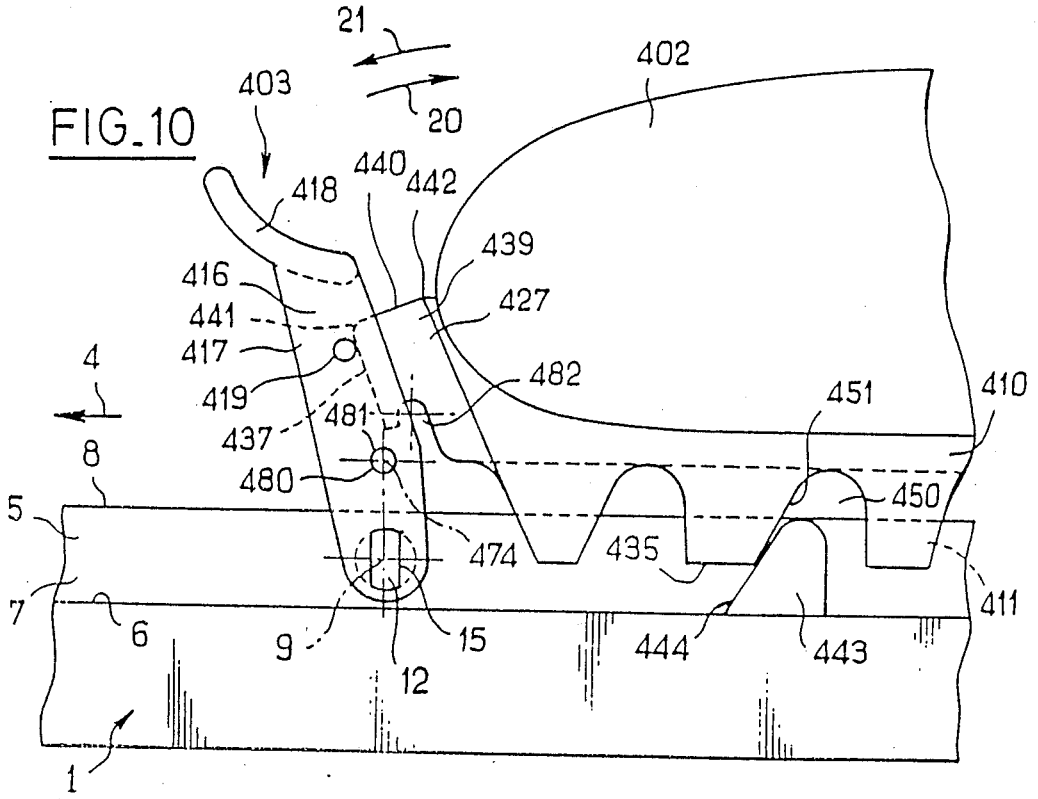
FIG. 10 is a view similar to FIG. 2 but showing a fifth embodiment of the present invention.

In general, the different embodiments of the present invention are similar to the embodiments described in the above-identified French patent application; nevertheless, the present invention could also find its application in other types of cross-country ski bindings. In the drawings, reference numeral 1 designates a longitudinal ski associated with boot 2 (FIGS. 1 and 2 in the first embodiment), boot 102 (FIGS. 3 and 4 in the second embodiment), boot 202 (FIGS. 5 and 6 in the third embodiment), boot 302 (FIGS. 7 and 8 in the fourth embodiment) and boot 402 (FIGS. 9 and 10 in the fifth embodiment). In each embodiment, the boot is or can be journalled about a transverse axis, i.e., an axis that is perpendicular the median longitudinal plane of the ski, by means of binding 3 (FIGS. 1 and 2), binding 103 (FIGS. 3 and 4), binding 203 (FIGS. 5 and 6), binding 303 (FIGS. 7 and 8), and binding 403 (FIGS. 9 and 10).

In the following description, it is assumed that ski 1 rests flat on a horizontal surface, and that normal longitudinal direction of the ski is from front to back. Indication of the level and direction appearing in this description should not be construed as limiting the position in which the binding, according to the present invention, can be used. Rather, the terms should be considered only as indicative of the relative positioning of the different elements to facilitate their description. Nevertheless, the ski will generally occupy such position, at least approximately, during insertion of the boot into the binding to which the present invention is of particular interest.

Ski 1, illustrated as a nonlimiting example, comprises a ground-engaging portion, and an integral, central longitudinal rib 5 extending on the top of the ski along most of its length. Rib 5 lies between two longitudinal edges 6 that define a pair of upper surfaces which, in a localized section immediately near binding 3 (or bindings 103, 203, 303, and 404 in the other embodiments) are coplanar. Additionally, boot 2 (or boots 102, 202 302, 402 and the other embodiments) includes sole 10 (or sole 110, 210, 310, 410 in the other embodiments) having a central, continuous longitudinal groove 11 (or groove 111, 211, 311, 411 in the other embodiments) which is engageable with rib 5 in order to allow boot 2 (or boot 102, 202, 302, 402 in the other embodiments) to occupy a position illustrated in FIG. 1 (or FIGS. 3. 5, 7, 9 in the other embodiments). In this position of the boot, the sole of the boot rests flat on edges 6 of the upper surfaces ski 1, respectively, on each side of rib 5.

A design such as described above is known; and it would not be going beyond the scope of the present invention to adapt a modification to the ski in which rib 5 were reduced to a localized projection immediately near binding 3 (or bindings 103, 203, 303, 403 in the other embodiments). Therefore, further reference to rib 5 should be construed as including reference to a localized projection that replaces rib 5. Rib 5 has two side surfaces 7 that are parallel to the median longitudinal place of the ski and symmetrical to one another in relation to this plane. Sides 7 and mutually connected on top by the upper surface 8 of the rib in the form of a median longitudinal plane of the ski, and are connected on the bottom respectively to edges 6 of the ski.

A through-bore is provided in rib 5 along a transverse axis 9, i.e., an axis perpendicular to the median longitudinal plane of the ski. The bore interconnects sides 7 of rib 5 between edge surfaces 6 and upper surface 8. This bore coaxially receives shaft 12 having opposite ends 15 that project beyond each side surface 7 of rib 5. Shaft 7 has opposite end sections 13 each of which defines a cylindrical surface of revolution 14 with respect to axis 9. Sections 13 thus project beyond side surfaces 7 of rib 5, and terminate in ends 15 that are symmetrically located in relation to the median longitudinal plane of the ski.

U-shaped stirrup 16 (or stirrup 216, 316, 416 in the other embodiments) is mounted on ends 15 of shaft 12. To this end, stirrup 16 includes a pair of spaced arms 17 (or arms 117, 217, 317, 417 in the other embodiments) positioned perpendicularly to axis 9, the arms being parallel to one another and symmetrically located in relation to the median plane of ski 1. Crossbar 18 (or crossbars 118, 218, 318, 418 in the other embodiments) mutually connecting arms 17 is essentially parallel to axis 9 and spaced therefrom. More specifically, one each of arms 17 is connected to opposite ends 15 of shaft 12; and the other end of each arm is connected to crossbar 18 which extends transversely to the axis of the ski. Transverse pin 19, spaced from shaft 12 and bar 18, constitutes engagement means on the stirrup, and extends in a direction parallel to axis 9 between and interconnecting arms 17.

Figure 1:
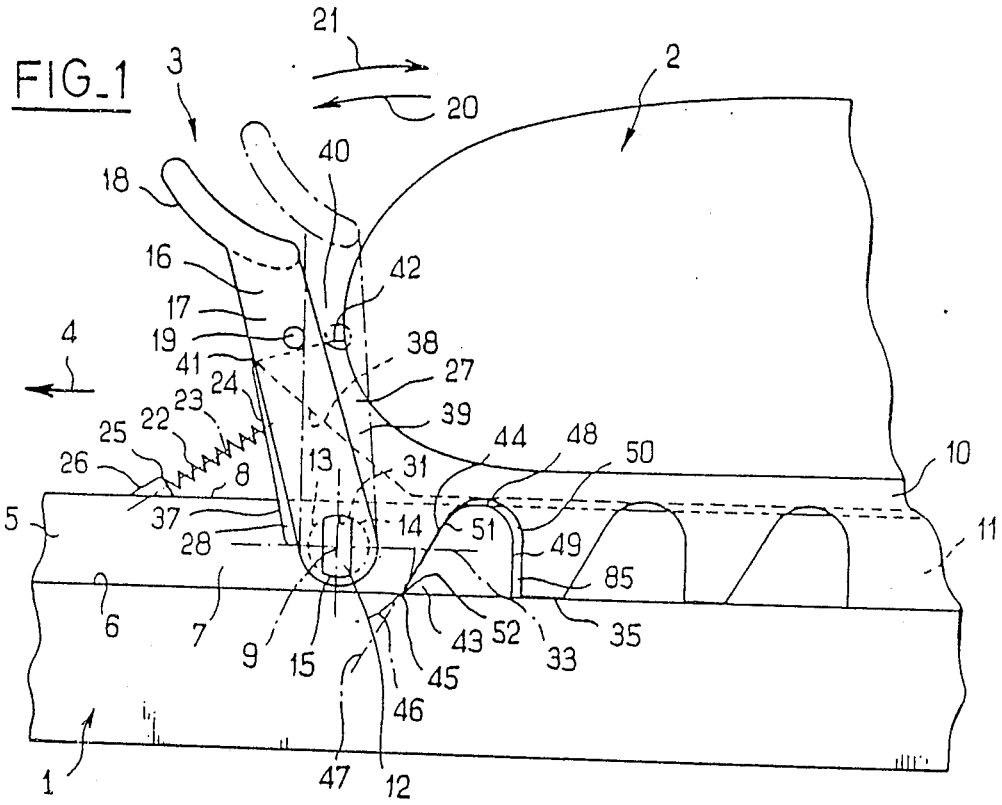
FIG. 1 is a side view of a first embodiment of the present invention showing the relative position of the stirrup to the boot when the latter is seated on a ski.

Spring means shown in the above identified French patent applications, or resilient means of another type, are provided for resiliently biasing stirrup 16 in predetermined direction 20 towards its neutral position illustrated in chain lines in FIG. 1. In this position of stirrup 16, arms 17 are approximately perpendicular to the ski so that, if the ski were resting flat on a horizontal surface, crossbar 18 and transverse pin 19 would be located essentially directly above axis 9. In addition to resiliently biasing stirrup 16 in direction 20, the spring means resiliently resist movement of the stirrup from its neutral position in reverse direction 21.

While the drawings show separate springs, resilient bias means can be integrated into rib 5, or into the localized projection that replaces this rib, in order to act directly on shaft 9 as described in French Patent Application No. 86/19545. Alternatively, all or part of the arms of the stirrup can be replaced as well as shaft 12 With a double-pin-spring as described in the preceding patent application. Alternatively, elastic bias means may be provided outside of rib 5, or the localized projection that replaces the rib, and can be utilized as described in French patent application No. 86/15944; or, other means can be provided to effect bias action on the stirrup.

In the present drawing, the elastic bias means is shown in the form of spiral spring 22 positioned in front of stirrup 16. The axis 23 of spring 22 is inclined towards the rear of the ski so that spring 22 is supported by rear end 24 on stirrup 16 above axis 9, and by front end 25 on abutment 26 fixed to rib 5 of the ski, or to the localized projection placing this rib on upper surface 8.

Figure 2:
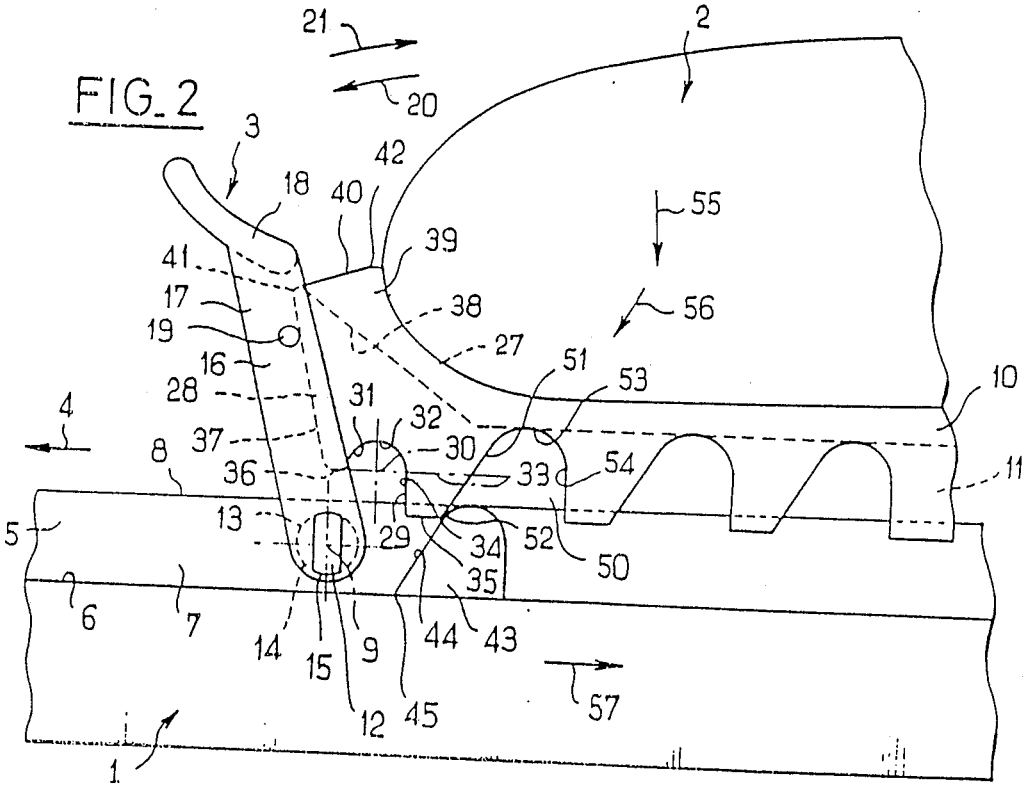
FIG. 2 is side view of the first embodiment of the invention showing the relative position of the stirrup when the ski boot is spaced from the ski and is about to be moved downwardly to effect automatic connection of the boot to the ski.

The first of the five embodiments illustrated in the drawings is now described in detail making reference to FIGS. 1 and 2. Referring now to FIG. 1, front projection 27 on the toe of the boot cooperates with end-sections 13 of shaft 12 to effect rotation of boot 2 about merged axes 9 and 30 relative to ski 1, and with transverse pin 19 on stirrup 16 in order to maintain the boot attached to the ski during cross-country use and as long as desired by the user. As shown in FIG. 1, the bottom of sole 10 of boot 2 rests flat on upper surface 6 of ski 1 on both sides of rib 5 which is engaged with groove 11 of sole 10.

As shown in FIG. 1, and as described in French Patent Application No. 86/15945, projection 27 is situated substantially above rib 5, or the localized projection replacing it, and is engaged with transverse pin 19 on stirrup 16. Toward the front and toward the bottom, projection 27 is provided with two spaced legs 28 symmetrical to one another in relation to the median longitudinal plane of ski 1. Each leg 28 is interposed, respectively, between side surfaces 7 of rib 5 and corresponding arm 17 of stirrup 16 to define a region supported on respective end sections 15 of shaft 12. As shown in FIG. 2, the bottom surface of each leg 28 contains transverse notch31 having edge 29 defined by a rectilinear generator perpendicular to the median longitudinal plane of ski 1, i.e., parallel to axis 30 which is collinear with axis 9 in the position shown in FIG. 1. The top of each notch 31 is defined by concave surface 32 in the form of a hemicylindrical surface of revolution around axis 30 with a diameter approximately identical to that of surface 14 of 13 of shaft 12. When boot 2 occupies its position shown in FIG. 1, each surface 32 engages surface 14 on section 13 on the half of the surface located above a horizontal plane 33 passing through merged axes 9 and 30.

Each of the hemicylindrical surfaces 32 extend downwardly below plane 33 behind axis 30 of notch 31, surface 34 of the notch lying in a plane that is perpendicular to plane 33 and connected to lower surface 35 of the sole which rests on surface 6 of ski 1 in the position shown in FIG. 1. Forwardly of axis 30, hemicylindrical surface 32 is connected to plane surface 36 approximately situated in plane 33. Each surface 36 is itself connected to planar front surface 37 of corresponding leg 28, surface 37 being perpendicular to the median longitudinal plane of ski 1. Front surfaces 37 of legs 28 play a part during insertion of the boot into the binding, in accordance with the present invention, as explained below.

Between spaced legs 28, front projection 27 of boot 2 is provided with front plane surface 38 which is perpendicular to the median longitudinal plane of the ski and inclined upwardly towards the front in the position shown in FIG. 1, but with a more pronounced angle than that of front surfaces 37 of legs 28. The preferred angle of surface 38 relative to bottom 35 is approximately 80° so as not to hamper pivotal movement in direction 20 around axis 9. This pivotal movement permits the user to extend his foot during cross-country skiing by rotating the boot about axis 9 until surface 38 contacts surface 8 of rib 5. Surface 38 does not come into effect during insertion of the boot into the binding.

Front surfaces 37 of legs 28 of projection 27 of boot 2, surface 38 of projection 27, and side surfaces 39 defining the lateral sides of projection 27, are planar, mutually parallel, and symmetrical relative to the median longitudinal plane of the ski. These front surfaces are also mutually spaced a distance no greater than the lateral spacing between arms 17 of stirrup 16. Upper surface 40 of projection 27 is planar and parallel to axis 30. In the position shown in FIG. 1, surface 40 is upwardly inclined towards the rear so as to define front edge 41 whose spacing in relation to the merged axes 9 and 30 is less than the spacing of the transverse pin 19 in relation to axis 30. Rear edge 42 of surface 40 is spaced from merged axes 9 and 33 a distance greater than the spacing of transverse pin 19 in relation to axis 30 in the position shown in FIG. 1. Rear edge 42 is located behind the plumb of axis 9. In its position shown in FIG. 1, transverse pin 19 on stirrup 16 abuts surface 40 due to the action of spring 22 on the stirrup in direction 20. Thus, when the boot is attached to the binding, the stirrup is moved from its position shown in by the chain lines in FIG. 1, and accompanies pivotal movement of boot 2 around axis 9 in relation to ski 1, as explained in French Patent Application No. 86/15945. In order to release the boot from the stirrup, the application of a downward force to cross bar 18 by means of a ski pole, for example, effects pivotal movement of the stirrup in direction 20 against the bias of spring 22. As a consequence, transverse pin 19 is removed from engagement with upper surface 40 of projection 27. The boot then can be removed from the binding by a simple, vertical lifting of the boot from the ski.

In accordance with the present invention and contrary to what was described in French Patent Application No. 86/15945, insertion of the boot into the binding does not require the use of a ski pole to effect access of notch 31 to end section 13 of shaft 12. Rather, the present invention provides cam means cooperable during downward movement of the boot relative to the ski for effecting relative forward displacement of the boot until the sole thereof seats on the ski. The initial relative forward movement of the boot is utilized to automatically displace the stirrup from its neutral position against the bias of spring 22. During final forward movement of the boot, as shaft 12 enters notches 31, transverse pin 19 slips past edge 41 and rides up on surface 40 to the position shown in FIG. 1.

The cam means in the embodiment of FIG. 1 includes projections 43 located on upper surface 6, on each side of rib 5, rearwardly of axis 9, and behind stirrup 16. The front of each projection 43 presents surface 44, which may be planar and perpendicular to the median longitudinal plane of ski 1. Surface 44 is inclined towards the rear starting from edge 45 connecting this surface to upper surface 6 of ski 1. Surface 44 presents a slope that it is tangent to virtual cylinder 46 centered on axis 9 at the level of edge 45 as shown, and to virtual extension 47 of surface 44 below surface 6 of ski 1.

Ramp 43 further includes top convex surface 48 which connects to surface 44 opposite to edge 45. Surface 48 is defined by a generator perpendicular to the median longitudinal plane of the ski 1 and presents, for example, the shape of a part of a cylinder of revolution centered on an axis perpendicular to the median longitudinal plane of the ski. Surface 48 is itself connected toward the rear to surface 49, which may be planar. Surface 49 is essentially perpendicular to the median longitudinal plane of the ski, and essentially vertical in the position shown in FIG. 1. Two projections 43, are thus preferably provided on surface 6 of the ski on opposite sides of rib 5, and are in alignment in a direction perpendicular to the median longitudinal plane of ski 1.

In order to receive projections 43 in the position shown in FIG. 1, sole 10 of boot 2 contains recesses 50 that open into surface 35. These recesses are in alignment in relation to the median longitudinal plane of ski 1, and are located, respectively, on each side of groove 11 in the boot which receives rib 5. Recesses 50 thus constitute additional grooves of a traction notch system on the sole of the boot.

Each opening 50 presents a form suitable to engage surface 44 of projection 43 by providing a limited clearance between surfaces 48 and 49 when surface 35 of sole 10 rests on upper surface 6 of ski 1 on both sides of rib 5, and axes 9 and 30 coincide. The front of each opening 50 is defined by surface 51 that is planar and parallel to axis 30. Surface 51 is inclined in relation to surface 35 of sole 10 at the same angle that surface 44 of projection 43 is inclined relative to surface 6 of ski 1. One end of surface 51 is connected to surface 35 along rectilinear edge 52 parallel to axis 30; and the other end is connected to surface 53 in the shape of part of a cylinder of revolution centered on an axis parallel to axis 30, with a diameter greater than the diameter of surface 48 on the projection. The distance of edge 52 to the connection between surfaces 51 and 53 is greater than the distance between edge 45 and the mutual connection of surfaces 44 and 48 of projection 43.

Towards its rear, surface 53 is itself connected to plane surface 54 that is perpendicular to surface 35. Thus, in the position shown in FIG. 1, surfaces 44 and 51 are cooperable cam means on the boot and binding. When the boot is seated on the ski, surfaces 44 and 51 are in contact, and edges 45 and 52 coincide. However, some play exists between rounded surfaces 48 and 49, on the one hand, and planar surfaces 49 and 54 on the other hand. Because of this limited play between projection 43 and opening 50 when the boot is seated on the ski and axes 9 and 30 are merged, pivotal movement of boot 2 and stirrup 16 either in direction 20 or direction 21, is not hampered by the cooperation of projection 43 and openings 50. Rather, this cooperation effects automatic insertion of the boot as described below in reference to FIG. 2.

It is assumed that in an initial state, ski 1 rests flat on a horizontal surface, and boot 2 is totally independent of the ski. In such case, spring 22 causes stirrup 16 to occupy its neutral position illustrated in broken lines in FIG. 1.

The skier first brings boot 2 into an approximately horizontal position, above ski 1, by aligning, as precisely as possible, groove 11 in sole 10 with rib 5, and by placing axis 30 behind, but as close as possible, to the plumb of axis 9. The required alignment is facilitated by contacting front surfaces 37 of legs 28 of projection 27 with transverse pin 19 as shown in FIG. 2. This contact may be accompanied, if necessary, by a light forward push applied to transverse pin 19 by means of the front projection 27 of boot 2 without risking imparting longitudinal sliding of the ski on the surface. Spring 22 offers little resistance to rotation of stirrup 16 in direction 20 when the stirrup occupies its neutral position.

Due to the appropriate relative dimensioning and positioning of projection 27 and openings 50 of the boot, as well as stirrup 16 and projection 43 of ski 1, each opening 50 will be aligned with a projection. Specifically, openings 50 present at the plumb of a section of surface 44 of projection 43 immediately adjacent surface 48 is adjacent surface 51 directly adjacent to edge 52 connecting with lower surface 35 of sole 10.

If, at this point, the skier brings boot 2 down approximately vertically towards ski 1, as shown schematically by arrow 55 in FIG. 2, cooperable cam means in the form of surfaces 51 and 44 come into mutual sliding contact as the boot moves forwardly simultaneously with the descending movement of the boot on the ski, as shown schematically by arrow 56 in FIG. 2. Alternatively, the downward movement of the boot may provoke a rearward sliding of the ski on the surface, as shown schematically by an arrow 57. However, the boot moves forwardly relative to the ski in either case. At the same time, front surfaces 37 of legs 28 abut transverse pin 19 of stirrup 16. Surfaces 37 and pin 19 constitute mutual engagement means that are engaged during cooperation of cam means 44 and 51. Given the suitable inclination of surfaces 44 of projections 43 and surfaces 51 of openings 50, initial forward displacement of the boot effects pivotal movement of stirrup 16 in direction 20 against the action of spring 22. In other words, front surfaces 37 of legs 28 are ramps that slidably engage transverse pin 19 of stirrup 16 while the boot 2 is being brought downwardly towards ski 1 causing greater and greater compression of spring 22 and a higher and higher force exerted on stirrup 16 in direction 21.

When, during this guided descending movement of boot 2 towards ski 1, surface 35 of sole 10 reaches the immediate vicinity of surface 6 of ski 1 on both sides of rib 5, the edge between surfaces 31 and 36 of each leg 28 contacts the peripheral surface 14 of section 13 of shaft 12 situated on the same side of rib 5, preferably in front of the plumb of axis 9. As a consequence, during final displacement of the boot relative to the ski as sole 10 of the boot comes to rest against surfaces 6 of ski 1, axes 9 and 30 move into coincidence as openings 31 on the boot seats on respective sections 13 of shaft 12. In this embodiment, pin 13 constitutes a connector pin and opening 31 constitutes a receiver that pivotally receives the connection pin: The required positioning and dimensioning of openings 31 and 50, of shaft 12 and of projections 43 is with the realm of the normal ability of persons of ordinary skill in the art.

During the final descending movement of boot 2 towards ski 1, transverse pin 19 slips past edge 41 on front surfaces 37 of legs 28. When this occurs, stirrup 16 is released for rotation in direction 21 due to the action of spring 22. Thus, pin 19 gradually slides on surface 40 and eventually reaches its position illustrated in solid lines in FIG. 1. In this position, pin 19 bears downwardly and rearwardly on surface 40 of projection 27 so as to retain openings 31 in legs 28 in coaxial contact with shaft 12.

Then, as explained in French Patent Application No. 86/15945, stirrup 16 and boot 2 can act as a total support vis-a-vis a rotation around merged axes 30 and 9 in relation to ski 1. Furthermore, the boot can be removed by the manual application of a force to crossbar 18, for example, by using a ski pole to push against the crossbar in direction 20.

Figure 3:
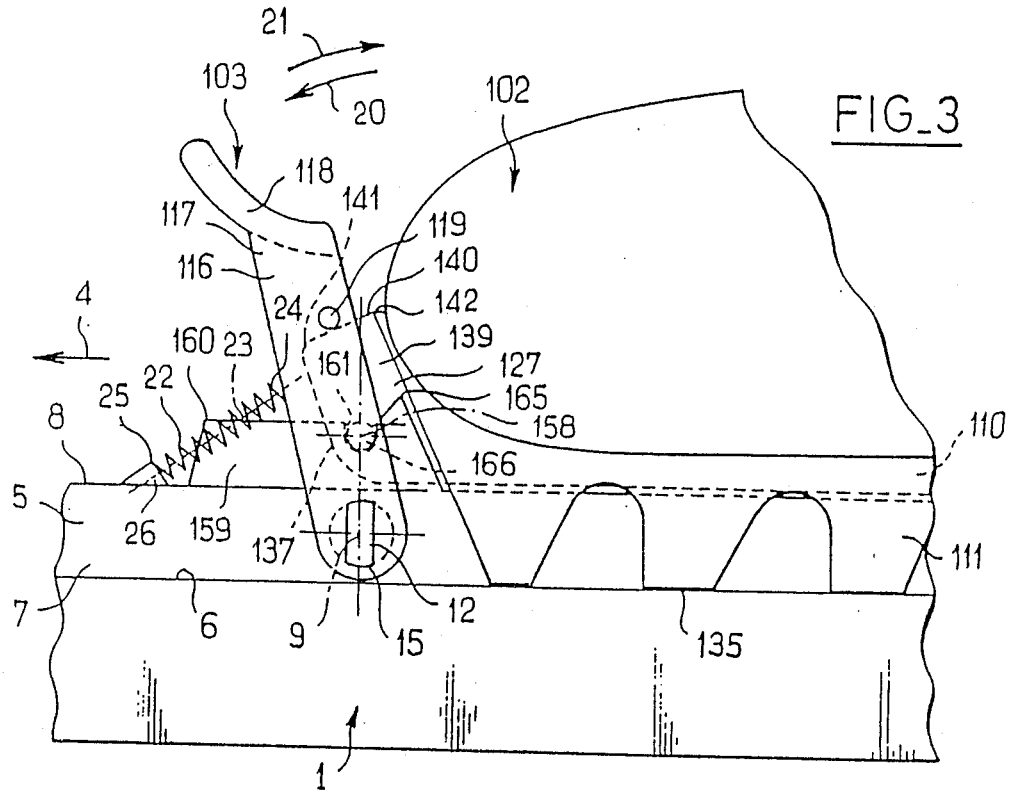
FIG. 3 is a view similar to FIG. 1 but showing a second embodiment of the present invention.
Figure 4:
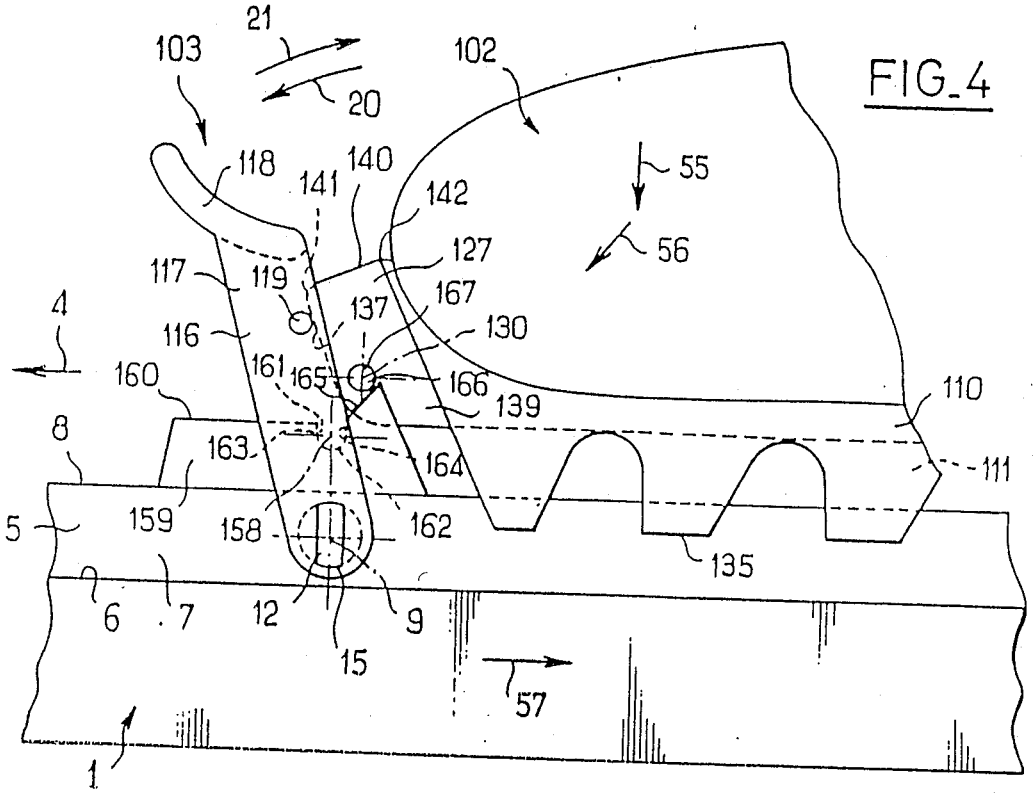
FIG. 4 is a side view similar to FIG. 2 but showing a second embodiment of the present invention.

Reference is now made to FIGS. 3 and 4 which show a second embodiment of the invention. In this embodiment, the connector pin is on the boot and the receiver is on the binding; and, instead of journalling the boot for pivotal movement about axis 9, about which stirrup 16 pivots, as in the case of the first embodiment shown in FIGS. 1 and 2, boot 102 in the second embodiment is journalled on ski 1 around axis 158 displaced in relation to axis 9, but is located at a level higher than the level of axis 9. More specifically, in the non-limiting illustrated example, axis 158 is arranged at approximately the plumb of axis 9, above upper surface 8 of rib 5 or of the localized projection replacing it.

In order to define axis 158, rib 5 has affixed on surface 8 near edges 7, and projecting thereover, two brackets 159 symmetrically located in relation to the median longitudinal plane of the ski. Each of brackets 159 is notably defined by top edge 160 defined by a generator parallel to axis 158. The centers of aligned grooves 161 in edges 160 define axis 158. As best shown in FIG. 4, grooves 161 are open towards the top and are defined toward the bottom by hemicylindrical surface 162 of revolution centered on axis 158. Hemicylindrical surface 162 is connected toward the top to plane surfaces 163, 164 parallel to one another, and substantially perpendicular to surface 6. These plane surfaces extend towards edge 160 of each bracket 159. Immediately in front of groove 161, edge 160 is, for example, planar and horizontal as seen in FIGS. 3 and 4. Immediately to the rear of groove 161, i.e., immediately at the upper, part of surface 164 of the grove, edge 160 presents ramp 165 that is rearwardly inclined. Ramp 165 is, for example, planar and perpendicular to the median longitudinal plane of ski 1. In this embodiment, ramp 165 and pin 167 constitute cooperable cam means which functionally replace cooperable cam means 34 and 50 in the first embodiment, to assure a relative guiding of the boot and the ski during insertion of the boot, as will appear below. When, as is the case of the embodiment illustrated in FIGS. 3 and 4, the boot is designed to be journalled directly on the ski around an axis different from the journalling axis of the stirrup, the cam means employed in the embodiment of FIGS. 1 and 2 could be employed in place of ramp 165 and pin 167.

In order to cooperate with transverse pin 119 and stirrup 116 and to be journalled around axis 158 on ski 1, sole 110 of boot 102 includes forward projection 127. To facilitate the description of this embodiment, projection 127 is described in reference to the position of the boot shown in FIG. 3, as well as the position shown in FIG. 4.

In FIG. 3, projection 127 is situated above rib 5, or the localized projection replacing it, and positioned inside stirrup 116 between transverse pin 119 of the stirrup and upper surface 8 of rib 5, projection 127 fitting laterally between arms 117 of the stirrup.

Projection 127 includes two lateral, plane surfaces 139 equally spaced from the median longitudinal plane of the ski when boot 102 is connected to it by binding 103 as shown in FIG. 3. Surfaces 139 are parallel to the median longitudinal plane and are spaced a distance approximately equal to the distance separating brackets 159 so that projection 127 is slidably insertable between these brackets.

Projection 127 includes downwardly and forwardly directed front edge 137 whose shape is such that it does not hamper the pivotal movement of boot 102 on binding 103 during cross-country skiing. Thus, edge 137 is connected by a convex section to a transverse surface (not shown) containing a notch that matches groove 11 in sole 10. Edge 137 presents a plane shape that is perpendicular to the median longitudinal plane of the ski and slopes upwardly as seen in FIG. 3, in order to constitute, during insertion of the boot, a ramp that cooperates with transverse pin 119 of stirrup 116 in the same way that front surfaces 37 of legs 28 of projection 27 cooperate with transverse pin 19 of stirrup 16 during insertion of the boot of the embodiment of FIGS. 1 and 2 into a binding.

Projection 127 includes upper surface 140 connected to edge 137 at rounded corner 141, and lateral side surfaces 139 connected at the top. Preferably, upper surface 140 is planar, although another shape may also be chosen. Upper surface 140 presents a surface suitable to effect engagement with transverse pin 119 of stirrup 116 as shown in FIG. 3. Surface 140 is inclined rearwardly and is thus similar to surface 40 of projection 27 in the first embodiment of the invention. That is to say, the distance of front corner 141 to axis 9 is less than the distance of transverse pin 119 to axis 9. The distance of rear corner 142 to axis 9 is greater than the distance of transverse pin 119 to axis 9. Thus, most of the upper surface 140 of projection 127 between edges 141 and 142 is further from axis 9 than transverse pin 119. As shown in FIG. 3, a portion of surface 140 is located directly along the plumb of axis 9. Thus, when pin 119 engages surface 140, stirrup 116 cannot move to its neutral position described above, and the stirrup will be inclined slightly from the plumb.

Projection 127 carries shaft 166 whose axial ends project beyond lateral surfaces 139 of the projection. Shaft 166 may be embedded, or partially encased in projection 127. However, the axial ends of shaft 166 project beyond surface 139 a distance about equal to the thickness of brackets 159 measured along axis 158. The projected portions of shaft 166 present respective peripheral cylindrical surfaces of revolution 167 centered on axis 130 with a diameter approximately identical to that of the bottom hemicylindrical surfaces 162 of grooves 161 in brackets 159. When transverse pin 119 is engaged with surface 140 of projection 124 as shown in FIG. 3, the projecting portions of shaft 166 are engaged with bottom surfaces 162 of grooves 161. In this manner, axis 158, which is the axis of shaft 166, is merged with axes 130. Thus, boot 102 is pivotal about merged axes 130 and 158. In this embodiment, shaft 166 on the boot constitutes a connector pin, and grooves 161 of the binding constitute a receiver for the connector pin.

The binding of this embodiment functions in the manner described below, assuming that ski 1 rests flat on an approximately horizontal surface before a boot is inserted in the binding. Stirrup 116 occupies its a neutral position (not shown) in which transverse pin 119 is situated at the plumb of axis 9. Stirrup 116 is urged toward its neutral position by spring 22 that constitutes resilient means.

To put on the ski, the user places boot 102 horizontally, at the plumb of ski 1, by aligning groove 11 in the bottom of the boot with rib 5. To achieve this, the respective axial projections on shaft 166 are aligned with the respective ramps 165. Additionally, surface 137 of projection 127 may be moved into contact with transverse pin 119 when the user applies frontward movement to the boot. At this point, the user may allow boot 2 to descend vertically toward the ski as schematically shown by arrow 55 in FIG. 4. Once contact is established between the axial projections of shaft 166 and ramps 165 of brackets 159, these ramps guide the projection of shaft 166 toward the inside of grooves 161. In response to descent of the boot towards ski 1, ramps 165 cooperate with the projections on the ends of shaft 166 to develop a forward component in relation to ski 1 as schematically shown by a slanted arrow 56 in FIG. 4. Alternatively, ski 1 may move rearwardly as schematically shown by arrow 57 in FIG. 4. In either case, during initial displacement of the boot, surface 137 of projection 127 engages transverse pin 119 and rotates stirrup 116 rotate in direction 20 against the bias of spring 22 until transverse pin 119 slips past edge 141 of projection 127. During final displacement of the boot relative to the ski, the projections at the ends of shaft 166 seat in grooves 161 of brackets 159 as spring 22 rotates stirrup 116 into engagement with surface 140 thereby retaining the boot to the ski when the sole of the boot engages surface 6 of the ski. This condition is shown in FIG. 3.

The operation in this embodiment during skiing, as well as during removal of the boot, is analogous to the operation of the first embodiment shown in FIGS. 1 and 2, except that, in the embodiment of FIGS. 3 and 4, the boot and the stirrup pivot around different axes, the extension movement of the foot of the user during cross-country skiing results in the sliding of transverse pin 119 on surface 140 of projection 127.

If the boot is to be journalled on the ski for pivotal movement around an axis different from the journalling axis of the stirrup on this ski, the specific cam means employed to ensure forward displacement of the boot relative to the binding is not limited to the cooperation between the connector pin in this embodiment and the receiver for the connector pin (i.e., the cooperation between pin 166 and edge 165) during insertion of the boot into the binding. Instead of this type of cam means, the type shown in the first embodiment can be utilized in the present embodiment. In such case, edges 165 can be eliminated and their functions achieved by providing projections 43 on the ski and by providing openings 150 in the sole of the boot as shown in FIGS. 1 and 2. In addition, or alternatively, the journalling of the boot on the ski may be established by providing in the ski, a groove like groove 161, to cooperate with pins (not shown) carried by a front section of the boot. As a further modification, shaft 166 can be replaced by a connector pin on the ski collinear with axis 158 and engageable with a notch (not shown) located forwardly and downwardly of the front section of the boot.

Figure 5:
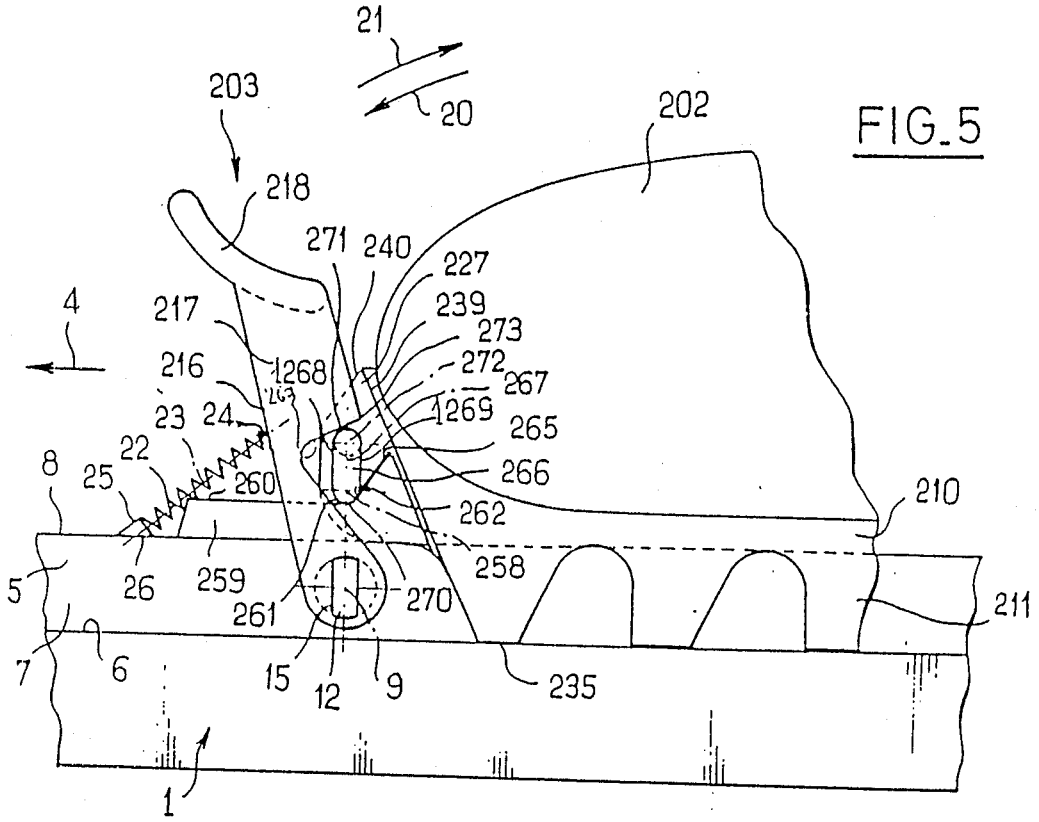
FIG. 5 is a side view similar to FIG. 1 but showing a third embodiment of the present invention.
Figure 6:
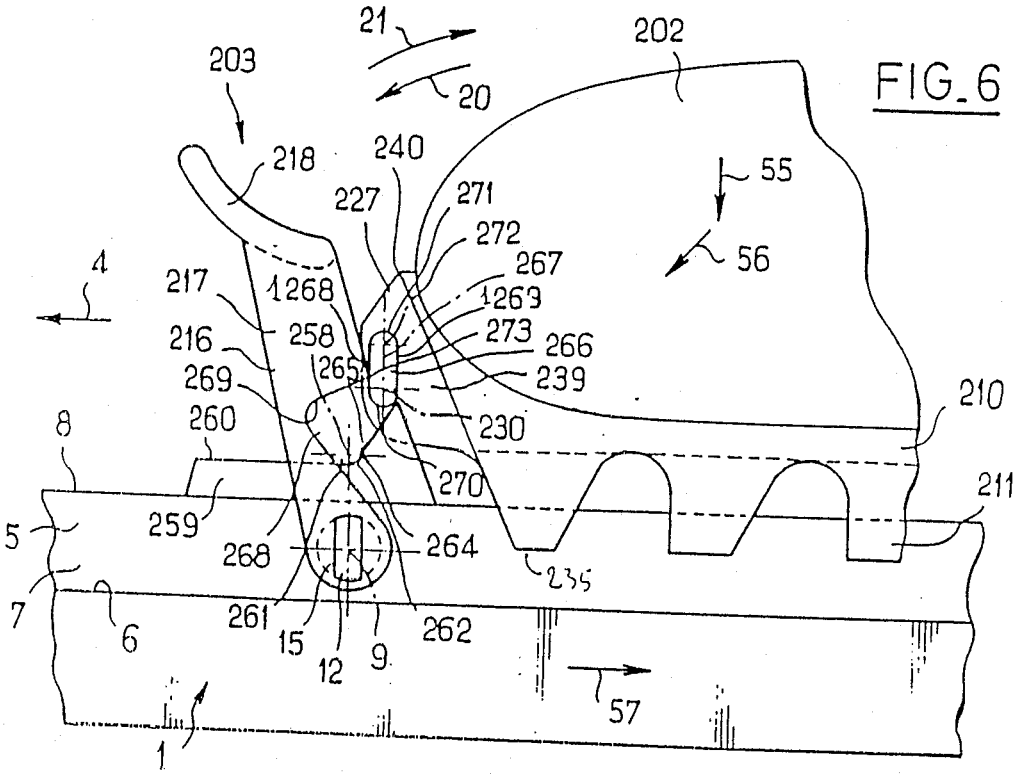
FIG. 6 is a side view similar to FIG. 2 but showing a third embodiment of the present invention.

Reference is now made to FIGS. 5 and 6 which show the third embodiment of the invention. Important analogies exist between the second and the third embodiments, and for this reason, elements that are identical, or are modifications of corresponding elements in FIGS. 3 and 4, are referred to below and shown in the drawings by reference numerals whose value is increased by one hundred over the value in the second embodiment.

An essential difference between binding 203 shown in FIGS. 5 and 6, and binding 103 shown in FIGS. 3 and 4, resides in the ability of binding 203 to maintain front projection 227 of boot 202 in journalled support on the binding without utilizing the functional equivalent of transverse bar 119. Surface 240 of projection 227 presents, in this embodiment, a shape designed to avoid any contact with crossbar 218 of stirrup 216.

In this embodiment, each of the two arms 217 of stirrup 216 is provided with notch 268 on the rearward edge of the arm. Notch 268 is enlarged rearwardly and downwardly in order to totally disengage a virtual coaxial extension of grooves 261 on edges 260 of brackets 259 in the position of stirrup 216 illustrated in FIG. 5. In addition, notch 268 is configured to disengage bar 266 in any position of stirrup 217 as the latter moves in direction 20.

Each notch 268 is defined by upper surface 269 that slopes rearwardly in the position shown in FIG. 5, i.e., turned downwardly and rearwardly. Surface 269 is perpendicular to the median longitudinal plane of the ski, is planar, but could have other shapes, and is selected based on the change that one desires to give to the return connection applied to boot 202 based on the angular position of the boot relative to axis 268.

In effect, each surface 269 is designed to function as a sliding support ramp, sloping rearwardly and downwardly, in cooperation with transverse bar 266 which is part of the front projection 227 of boot 202.

More specifically, bar 266 is rectilinear but has rounded edges and may be partially embedded in front projection 227 of boot 202. Bar 266 extends transversely to the axis of the ski in a direction perpendicular to the median longitudinal plane of the ski when the ski is put on. In relation to the two lateral surfaces 239 of the front projection 227 of boot 202, the free ends of bar 266 project laterally from surface 239 a distance greater than the thickness of each bracket 259 measured parallel to axis 258. Each free end thus forms a projection in relation to each bracket 259 which is normal to the median longitudinal plane of the ski thereby engaging notches 268 in arms 217 of stirrup 216.

Bar 266 defines mid-plane 267 that is vertically oriented when the boot rests flat on the ski as shown in FIG. 5. This bar is defined, respectively, by frontward and rearward plane surfaces 1268, 1269 which are parallel and symmetrical relative to plane 267. The upper and lower surfaces of bar 266 are defined by hemicylindrical surfaces 270 and 271. Lower surface 270 is a surface of revolution centered on axis 230 which is merged with the common axis 258 of grooves 261 on top edges 260 of brackets 259. As a result, surface 270 acts a pin in these grooves and ensures the rotation of boot 202 around axis 258 in relation to ski 1. Upper surface 271 is a hemicylindrical surface of revolution centered on axis 272 which is parallel to axis 30 located above it as shown in FIG. 5. Upper surfaces 269 of notches 268 in arms 217 of stirrup 216 are engageable with upper surfaces 271 of bar 266 when the ski is put on.

One of ordinary skill in the art easily understands that the cooperation between upper hemicylindrical surface 271 of bar 266 and each one of the surfaces forming ramp 269 is analogous to the cooperation between transverse 119 of stirrup 116 and upper surface 140 of the front projection 127 of boot 102 in the second embodiment of this invention.

In order to control pivotal movement of boot 202 about axis 258, each notch 261 is open not only towards the top, but also towards the front as is shown in FIG. 6. The rear of notch 261 is defined by vertical surface 264 which corresponds to surface 164 in the second embodiment. The bottom surface 262 of notch 261 corresponds to surface 162 in the second embodiment except that the final 90° of the notch relative to axis 258 is open. Thus, the front of surface 262 is directly connected to an upper horizontal section of edge 260 of bracket 259. Ramp 269 of notch 268 bears on surface 271 of bar 266 to maintain surface 270 engaged against bottom surface 262 of each groove 261. Bottom surface 270 of bar 266 presents approximately the same diameter as the bottom surfaces 262 of grooves 261.

In the third embodiment shown in FIGS. 5 and 6, ramp 265 on bracket 259 corresponds to ramp 65 in the second embodiment. Thus, ramp 268 is inclined rearwardly from surface 264 of each groove 261. Ramps 265 could be replaced, in its function of guiding of the boot during its insertion, by projections on the ski comparable to projections 43 in the first embodiment of the invention shown in FIGS. 1 and 2.

In the present embodiment, insertion of the boot is carried out in the manner described below assuming that ski 1 rests flat on a horizontal surface. Absent an obstacle opposing it, stirrup 216 is urged by spring 22 toward its neutral position at which upper surfaces 269 of notches 268 present rear convex edge 273 to bar 266 at the plumb of rear section of the surfaces forming ramp 265 of brackets 259 as shown in FIG. 6.

In order to put on the ski, the user raises his boot 202 above the ski and aligns groove 211 in the sole of the boot with rib 5. Surfaces 271 of bar 266, which are located on opposite sides of front projection 227 of boot 202, are positioned by the user such that front surfaces 1268 of bar 266 are placed in contact with edge 273 of the stirrup. By applying a forward displacement to the boot, stirrup 216 is pivoted in direction 20 during the time boot 202 begins its vertical descent towards ski 1 as schematically shown by an arrow 55 in FIG. 6. Bar 266 and ramp 265 from cooperable cam means that effect forward displacement of the boot relative to the ski in response to downward movement of the boot. After contact is established between surface 270 of bar 266 and ramps 265, sliding movement of bar 266 continues until surface 270 of the bar rests against bottom surfaces 264 of notches 268. This movement is accompanied by a comparable forward movement of boot 202 in relation to the ski as schematically shown by arrow 56, and/or by a rear movement of the ski as schematically shown by arrow 57. Surface 1268 of bar 266 engaged against edges 273, imparts rotation to stirrup 216 in direction 20. During final displacement of boot 202 as the sole of the boot engages ski 1, surface 1268 slips over edge 273 and surface 271 of bar 266 then engages notch 269, At this point, stirrup 217 is biased by spring 22 in direction 21 to its position shown in FIG. 5.

The operation of such a binding during cross-country skiing or during removal of the ski is analogous to the operation embodiment of binding 103 described in reference in FIGS. 3 and 4.

Figure 7:
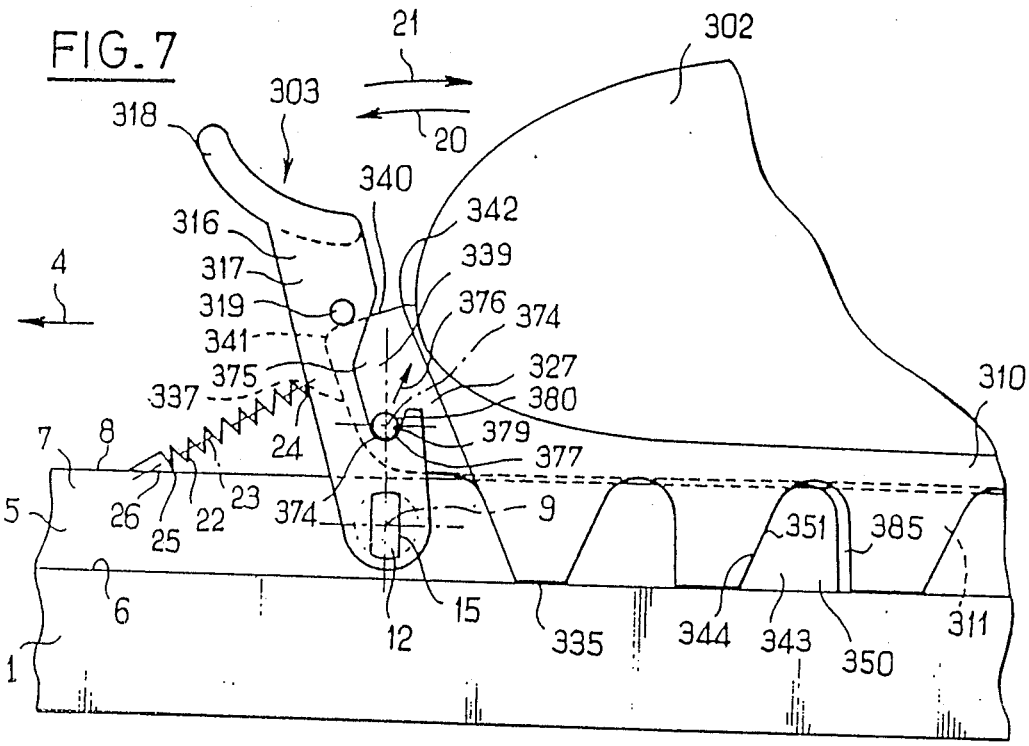
FIG. 7 is a side view similar to FIG. 1 but showing a fourth embodiment of the present invention.
Figure 8:
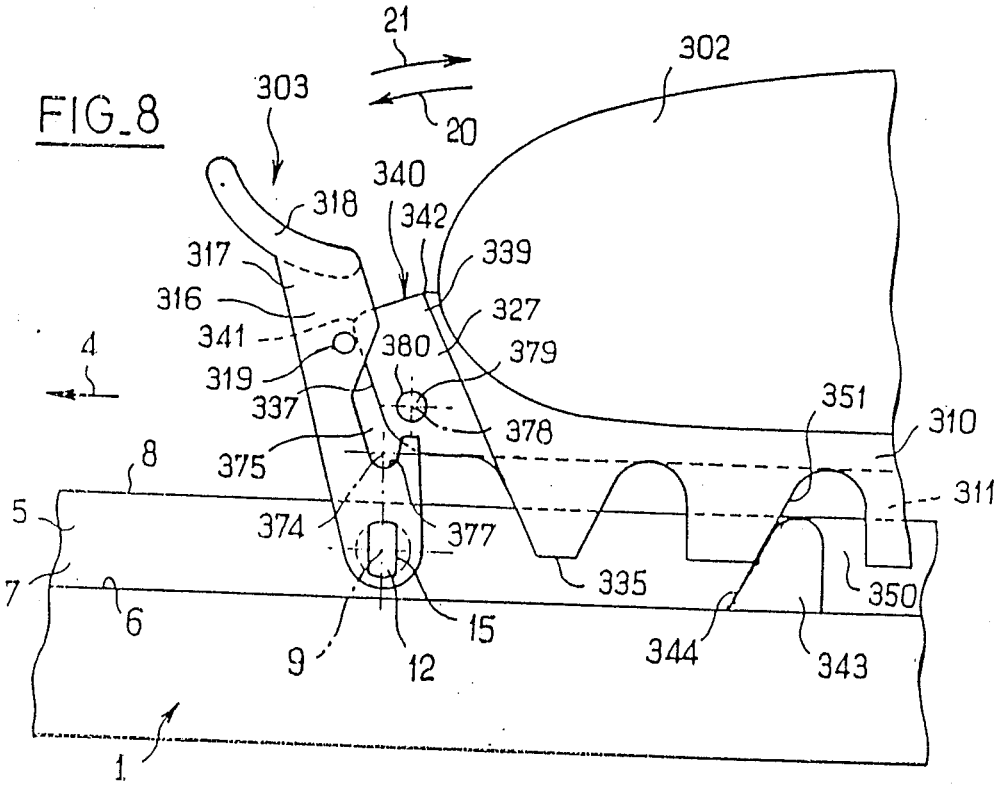
FIG. 8 is a side view similar to FIG. 2 but showing the fourth embodiment of the present invention.

Reference is now made to the embodiment shown in FIGS. 7 and 8 which is somewhat different from the previously described embodiment by reason of the location of axis 374 about which boot 302 of this embodiment is journalled. As shown in FIG. 7, axis 374 is located on the plumb of axis 9 about which stirrup 316 is journalled, but displaced above axis 9 and above surface 8 of rib 5. Like boot 2, boot 302 includes front projection 327, which may be integral with sole 310. Projection 327 serves as a removable connection of boot 302 with stirrup 316.

To this end, projection 327 is defined by two lateral plane surfaces 239 that are parallel, and symmetrically located relative to the median longitudinal plane of ski 1. The spacing between surfaces 239 is approximately equal to the distance separating arms 317 of stirrup 316. As a consequence, in the position shown in FIG. 7, projection 327 is slidably interposed between arms 317.

The front of projection 327 is defined by front surface 337 shaped to effect joint pivotal movement of boot 302 about axis 378 in binding 303 during cross-country skiing. Surface 337 is connected by a convex section to a surface (not shown) defining groove 311 of sole 310. In addition, surface 337 presents a shape, for example a plane, that is inclined forwardly as seen in FIG. 7. The cooperation of cam means when boot 302 is inserted into binding 303 causes surface 337 to engage transverse pin 319 mounted on arm 317 of stirrup 316 and impart pivotal movement to stirrup 316 in direction 20 against the bias of spring 22.

Top edge 341 connects surface 337 to upper surface 340 which is comparable to surface 40 in the first embodiment. Specifically, surface 340 cooperates with transverse pin 319 when projection 327 is received within arms 317 of stirrup 316.

When boot 302 rests flat on the ski as shown in FIG. 7 and cooperates with binding 303, the distance of front edge 341 to axis 374 is less than the distance of pin 319 to this axis, and the distance of rear edge 342 to the axis is greater than the distance between pin 319 and the axis. As a consequence, pin 319 is rides on surface 340 as spring 22 urges stirrup 316 towards its neutral position. However, because of the spacing of surface 340 relative to axis 9, pin 391 rests on surface 340 at a location spaced from and forward of the plumb of axis 9.

Arms 317 of stirrup 316 contain two notches 375 open in direction 376, the notches widening towards the rear as viewed in FIG. 7. The bottom of notches 375 define axis 374 about which the boot is pivotal. Each of notches 375 is defined by generators parallel to axis 374 which define a hemicylindrical zone 377 of revolution centered on axis 374. Notches 375 are located in arms 317 between axis 374 and axis 9. The angular development of each notch 375 is less than, but almost equal to 180°. Each notch increases in size in direction 376 away from axis 9 up to a maximum at the edges of arms 317.

Projection 327 carries transverse pin 379, which may be encased in the projection, the axial ends of this pin extending beyond the side faces 339 of the projection and presenting a pair of opposed cylindrical peripheral surfaces of revolution 380 defining axis 378. The diameter of surface 380 is approximately equal to that of the bottom sections 377 of notches 375. When boot 302 is engaged in binding 303, axis 378 of surface 380 merges with axis 374 of notches 375 in the stirrup as shown in FIG. 7, and the lower portions of surfaces 380 are supported on bottom sections of notches 375. As a result, projection 327 is guided for pivotal movement about axis 374 in relation to arms 317 of stirrup 316 as pin 319 engages surface 341 between corner 341 of the projection and the plumb of axes 9 and 374.

The cam means in this embodiment cooperable during downward movement of boot 302 relative to binding 303 for effecting forward displacement of the boot relative to the ski employs projections 343 on surfaces 6 on opposite sides of rib 5 of the ski, and in this sense is analogous to the cam means utilized in the embodiment shown in FIGS. 1 and 2. As shown in FIGS. 7 and 8, each projection 343 has front surface 344 that is inclined upwardly toward the rear of the ski relative to axis 9 in a manner similar to the manner in which surface 44 in the first embodiment is configured.

Sole 310 on boot 302 has matching openings 350 for receiving projections 343, the openings serving the same function as openings 50 in the first embodiment. Each opening has a forwardly facing surface 351 that is inclined upwardly from the bottom 335 of the sole toward the back of the boot. Surface 351 of opening 350 engages surface 344 of projection 343 when the user aligns opening 350 with projection 343 and steps downwardly. Openings 350 are configured to provide clearance 385 for the reasons explained above in connection with clearance 55 in the first embodiment.

As a consequence of the above described cam means, insertion of boot 302 into binding 303 causes movement of the boot relative to the ski as surfaces 344 and 351 cooperate in the manner that surfaces 44 and 51 cooperate as described in connection with the first embodiment. In addition, the engagement of surface 337 on projection 327 with transverse pin 319 during forward movement of boot 302 relative to the binding effects pivotal movement of stirrup 316 in direction 20 against the bias of spring 22 from the neutral position of the stirrup in the same way that surface 37 interacts with pin 19 in the first embodiment. At the same time, the axial ends of shaft 379 enter notches 375 in arms 317 of the stirrup. Eventually, pin 319 rides over edge 341 and slidingly engages upper surface 340 as spring 22 urges the stirrup in direction 21 and as the axial ends of shaft 379 seats in recesses 377 and axes 378 and 374 merge. At this point, boot 302 is pivotal on the ski about merged axes 378 and 374 as well as about axis 9, spring 22 serving to resist pivotal rotation in direction 20 in response to rotation of the stirrup when the user effects the usual cross-country ski effort.

The embodiment of FIGS. 9 and 10 is distinguished from the embodiment of FIGS. 7 and 8 by replacing the notches carried by the arms of the stirrup, and the axial extensions on the shaft carried by the front projection of the boot with, respectively, a pin affixed to the arms of the stirrup and a notch carried by the projection of the boot. In the embodiment of FIGS. 9 and 10, structure that is identical to that in FIGS. 7 and 8 are identified by reference numerals whose value is greater by one hundred than reference numerals corresponding to the identical structure, except for notches 375 and shaft 379 in FIGS. 7 and 8. In the fifth embodiment of FIGS. 9 and 10, journalling axis 474 is defined by shaft 480 mounted on arms 417 of stirrup 416, and transverse recess 482 in front projection 427 of boot 402. Stirrup 416 is journalled for pivotal movement about axis 9.

In the case of this embodiment, arms 417 are connected rigidly by pin 480 which presents a cylindrical peripheral surface of revolution centered on axis 474 that is parallel to, and spaced from, axis 9. Front surface 437 of projection 427 of the boot is connected to and forms an extension of the upper surface (not shown) of groove 411 of sole 410 of boot 402. Downwardly opening notch 482 is provided in the bottom of projection 427 opposite top surface 440 which cooperates with transverse pin 419 when the boot is seated on the ski as shown in FIG. 9.

The operation of binding 403 is analogous to that of binding 303 described in reference in FIGS. 7 and 9, particularly in relation to the automatic insertion of the boot into the binding utilizing the cam means defined by projections 443 on the ski and openings 450 in the sole 411 of boot 402.

Naturally, it would not be outside the scope of the present invention to provide other variations of the embodiment, connected for example as preferred to another type of cross-country ski binding.

We claim:

1. A cross-country ski-binding member for releasably attaching the toe of a boot member to a ski having a longitudinal axis comprising:

(a) cam means on said members cooperable, during downward movement of the boot member relative to the binding member in a direction perpendicular to said axis, for effecting forward displacement of said boot member along said axis relative to the binding member until the sole of said boot member seats on said ski;

(b) a stirrup, mounting means for movably mounting said stirrup on said binding, said bias means for resiliently biasing said stirrup towards a neutral position;

(c) mutual engagement means on said stirrup and on said boot member, said engagement means being constructed and arranged so as to be engageable during cooperation of said cam means for effecting resilient displacement of said stirrup from its neutral position during initial forward displacement of said boot member, for effecting resilient displacement of said stirrup towards its neutral position during final displacement of said boot member, and for retaining said boot member to said ski after the boot member seats on the ski;

(d) a connector pin on one of said members positioned transversely to said longitudinal axis when said stirrup retains said boot member to said ski, said pin defining a transverse axis;

(e) a receiver on the other said members for pivotably receiving said connector pin and effecting a pivotal connection between the members while said boot members is retained to said ski; and (f) said connector pin and said receiver being constructed and arranged so that said boot member is pivotal on said binding member about said transverse axis of said pin.

2. A cross-country member ski binding member according to claim 1 wherein said cam means includes a projection on said binding member having an inclined ramp.

3. A cross-country ski binding according to claim 2 wherein said stirrup is mounted on said binding member for pivotal movement about a pivotal axis transverse to the longitudinal axis of the ski, and is biased in a rearward direction along the longitudinal axis of said ski.

4. A cross-country ski binding member according to claim 3 wherein said stirrup includes a pair of spaced arms, each arm having one end pivotal about said pivot axis, and a transverse crossbar interconnecting the respective other its resilient bias to release said boot member from said ski.

5. A cross-country ski binding member according to claim 4 wherein said connector pin is mounted on said boot member and said receiver is mounted on said binding member.

6. A cross-country ski binding member according to claim 5 wherein said connector pin constitutes said cam means on said boot member.

7. A cross-country ski binding according to claim 2 wherein said cam means include a recess in said boot member having an inclined ramp that matches the inclined ramp on said binding member.

8. A cross-country ski binding member according to claim 1 wherein said stirrup is mounted on said binding member for pivotable movement about a pivotable axis transverse to the longitudinal axis of the ski, and is biased in a rearward direction along the axis of said ski.

9. A cross-country ski binding according to claim 8 wherein said stirrup includes a pair of spaced arms, each arm having one end pivotable about said pivotable axis, and a transverse cross bar interconnecting the respective other ends of the said arms for manually pivoting said stirrup against its resilient bias to release said boot member from said ski.

10. A cross-country ski binding member according to claim 9 wherein said engagement means on said stirrup includes a transverse rod extending between said arms, and said engagement means on said boot member includes a front projection on the toe of said boot.

11. A cross-country ski binding member according to claim 10 wherein said front projection includes a front surface engageable by said rod during said initial forward displacement of said boot member.

12. A cross-country ski binding member according to claim 11 wherein said front projection includes an upper surface that is inclined relative to the longitudinal axis of the ski when the boot member is seated on the ski, said upper surface being engageable by said rod during said final forward displacement of said boot member.

13. A cross-country ski binding member according to claim 12 wherein said cam means on said binding member includes a ramp having a front surface inclined relative to the longitudinal axis of the ski.

14. A cross-country ski binding member according to claim 13 wherein said cam means on said boot member includes a recess in the sole of said boot member having a rear surface inclined relative to the longitudinal axis of the ski when the boot member is seated thereon, the inclination of the front surface of said ramp matching the rear surface of said recess.

15. A cross-country ski binding member according to claim 1 wherein said stirrup includes a pair of spaced arms, and a transverse cross bar interconnecting said arms for manually moving said stirrup against its resilient bias to release said boot member from said ski.

16. A cross-country ski binding member according to claim 15 wherein said connector pin is mounted on said binding member, and said receiver is mounted on said boot member.

17. A cross-country ski binding member for releasably attaching the toe of a boot member to a ski having a longitudinal axis comprising:

(a) cam means on said members cooperable, downward movement of the boot member relative to the binding member in a direction perpendicular to said axis, for effecting forward displacement of said boot member along said axis relative to the binding member until the sole of said boot member seats on said ski;

(b) a stirrup on said binding movably mounted thereon and resiliently biased towards a neutral position;

(c) mutual engagement means on said stirrup and on said boot member, said engagement means being engageable during cooperation of said cam means for effecting resilient displacement of said stirrup from its neutral position during initial forward displacement of said boot member, for effecting resilient displacement of said stirrup towards its neutral position during final displacement of said boot member, and for retaining said boot member to said ski after the boot member seats on the ski;

(d) a connector pin on one of said members positioned tranversely to said axis when said stirrup retains said boot member to said ski; and (e) a receiver on the other said members for pivotably receiving said connector pin and effecting a pivotal connection between the members while said boot member is retained to said ski;

(f) wherein said cam means includes a projection on said binding member having an inclined ramp;

(g) wherein said stirrup is mounted on said binding member for pivotal movement about a pivotable axis transverse to the longitudinal axis of the ski, and is biased in a rearward along the axis of said ski;

(h) wherein said stirrup includes a pair of spaced arms, each arm having one end pivotal about said pivot axis, and a transverse crossbar interconnecting the respective other ends of said arms for manually pivoting said stirrup against its resilient bias to release said boot member from said ski; and (i) wherein said binding member includes a central rib elongated in the direction of the longitudinal axis of the ski, and a shaft passing through said rib in a direction transverse to the longitudinal axis of the ski and defining said pivotal axis, said one end of each arm being pivotally mounted on the axial end of said shaft.

18. A cross-country ski binding member for releasably attaching the toe of a boot member to a ski having a longitudinal axis comprising:

(a) cam means on said members cooperable, during downward movement of the boot member relative to the binding member in a detection perpendicular to said axis, for effecting forward displacement of said boot member along said axis relative to the binding member until the sole of said boot member seats on said ski;

(b) a stirrup, mounting means for movably mounting said stirrup on said binding, and bias means for resiliently biasing said stirrup towards a neutral position;

(c) mutual engagement means on said stirrup and on said boot member, said engagement means being constructed and arranged so as to be engageable during cooperation of said cam means for effecting resilient displacement of said stirrup from its neutral position during initial forward displacement of said boot member, for effecting resilient displacement of said stirrup towards its neutral position during final displacement of said boot member, and for retaining said boot member to said ski after the boot member seats on the ski;

(d) a connector pin on one of said members positioned transversely to said axis when said stirrup retains said boot member to said ski; and (e) a receiver on the other said members for pivotably receiving said connector pin and effecting a pivotal connection between the members while said boot member is retained to said ski;

(f) wherein said cam means includes a projection on said binding member having an inclined ramp, wherein said stirrup is mounted on said binding member for pivotal movement about a pivotal axis transverse to the longitudinal axis of the ski, and is biased in a rearward direction along the axis of said ski, and wherein said stirrup includes a pair of spaced arms, each arm having one end pivotal about said pivot axis, and a transverse crossbar interconnecting the respective other ends of said arms for manually pivoting said stirrup against its resilient bias to release said boot member from said ski; and (g) wherein said engagement means on said stirrup includes a transverse rod extending between said arms, and said engagement means on said boot member includes a front projection on the toe of said boot.

19. A cross-country ski binding member according to claim 18 wherein said front projection includes a front surface engageable by said rod during said initial forward displacement of said boot member.

20. A cross-country ski binding member according to claim 19 wherein said front projection includes an upper surface that is inclined relative to the longitudinal axis of the ski when the boot member is seated on the ski, said upper surface being engageable by said rod during said final forward displacement of said boot member.

21. A cross-country ski binding member according to claim 20 wherein said ramp on said binding member has a front surface inclined relative to the longitudinal axis of the ski.

22. A cross-country ski binding according to claim 21 wherein said cam means on said boot member includes a recess in the sole of said boot member having a rear surface inclined relative to the longitudinal axis of the ski when the boot member is seated thereon, the inclined of the front surface of said ramp matching the rear surface of said recess.

23. A cross-country ski binding member for releasably attaching the toe of a boot member to a ski having a longitudinal axis comprising:

(a) cam means on said members cooperable, during downward movement of the boot member relative to the binding member in a direction perpendicular to said axis, for effective forward displacement of said boot member along said axis relative to the binding member until the sole of said boot member seats on said ski;

(b) a stirrup, mounting means for movably mounting said stirrup on said binding, and bias means for resiliently biasing said stirrup towards a neutral position;

(c) mutual engagement means on said stirrup and on said boot member, said engagement means being constructed and arranged so as to be engagable during cooperation of said cam means for effective resilient displacement of said stirrup from its neutral position during initial forward displacement of said boot member, for effecting resilient displacement of said stirrup towards its neutral position during final displacement of said boot member, and for retaining said boot member to said ski after the boot member seats on the ski;

(d) a connector pin on one of said members positioned transversely to said axis when said stirrup retains said boot member to said ski; and (e) a receiver on the other said members for pivotably receiving said connector pin and effecting a pivotal connection between the members while said boot member is retained to said ski;

(f) wherein said cam means includes a projection on said binding member having an inclined ramp, wherein said stirrup is mounted on said binding member for pivotal movement about a pivotal axis transverse to the longitudinal axis of the ski, and is biased in a rearward direction along the axis of said ski, and wherein said stirrup includes a pair of spaced arms, each arm having one end pivotal about said pivot axis, and a transverse crossbar interconnecting the respective other ends of said arms for manually pivoting said stirrup against its resilient bias to release said boot member from said ski; and (g) wherein said connector pin is mounted on said binding member, and said receiver is mounted on said boot member.

24. A cross-country ski binding member according to claim 23 wherein said connector pin extends between said arms, and said receiver is a matching notch in a projection on the toe of said boot member.

25. A cross-country ski binding member for releasably attaching the toe of a boot member to a ski having a longitudinal axis comprising:

(a) cam means on said members cooperable, during downward movement of the boot member relative to the binding member in a direction perpendicular to said axis, for effecting forward displacement of said boot member along said axis relative to the binding member until the sole of said boot members seats on said ski;

(b) a stirrup, mounting means for movably mounting said stirrup on said binding, and bias means for resiliently biasing said stirrup towards a neutral position;

(c) mutual engagement means on said stirrup and on said boot member, said engagement means being constructed and arranged so as to be engageable during cooperation of said cam means for effecting resilient displacement of said stirrup from its neutral position during initial forward displacement of said boot member, for effecting resilient displacement of said stirrup towards its neutral position during final displacement of said boot member, and for retaining said boot member to said ski after the boot member seats on the ski;

(d) a connector pin on one of said members positioned transversely to said axis when said stirrup retains said boot member to said ski; and (e) a receiver on the other said members for pivotably receiving said connector pin and effecting a pivotal connection between the members while said boot member is retained to said ski;

(f) wherein said cam means includes a projection on said binding member having an inclined ramp;

(g) wherein said stirrup is mounted on said binding member for pivotal movement about a pivotal axis transverse to the longitudinal axis of the ski, and is biased in a rearward direction along the longitudinal axis of said ski;

(h) wherein said stirrup includes a pair of spaced arms, each arm having one end pivotal about said pivot axis, and a transverse crossbar interconnecting the respective other ends of said arms for manually pivoting said stirrup against its resilient bias to release said boot member from said ski;

(i) wherein said connector pin is mounted on said binding member, and said receiver is mounted on said boot member; and (j) wherein said binding member includes a rib elongated in the direction of the longitudinal axis of the ski, said connector pin being mounted in said rib and extended in a direction transverse to the longitudinal axis of the ski, said receiver being a notch in said boot member.

26. A cross-country ski binding according to claim 25 wherein said connector pin is in the form of a shaft passing through said rib in a direction transverse to the longitudinal axis of the ski and defining said pivotal axis, said one of each arm being pivotally mounted on an axial end of said shaft.

27. A cross-country ski binding member according to claim 26 wherein a portion of said shaft constitutes said connector pin.

28. A cross-country ski binding member for releasably attaching the toe of a boot member to a ski having a longitudinal axis comprising:

(a) cam means on said members cooperable, during downward movement of the boot member relative to the binding member in a direction perpendicular to said axis, for effecting forward displacement of said boot member along said axis relative to the binding member until the sole of said boot member seats on said ski;

(b) a stirrup, mounting means for movably mounting said stirrup on said binding, and bias means for resiliently biasing said stirrup towards a neutral position;

(c) mutual engagement means on said stirrup and on said boot member, said engagement means being constructed and arranged so as to be engageable during cooperation of said cam means for effecting resilient displacement of said stirrup from its neutral position during initial forward displacement of said boot member, for effecting resilient displacement of said stirrup towards its neutral position during final displacement of said boot member, and for retaining said boot member to said ski after the boot member seats on the ski;

(d) a connector pin on one of said members positioned transversely to said axis when said stirrup retains said boot member to said ski; and (e) a receiver on the outer said members for pivotably receiving said connector pin and effecting a pivotal connection between the members while said boot member is retained to said ski;

(f) wherein said cam means includes a projection on said binding member having an inclined ramp, wherein said stirrup is mounted on said binding member for pivotal movement about a pivotal axis transverse to the longitudinal axis of the ski, and is biased in a rearward direction along the axis of said ski, wherein said stirrup includes a pair of spaced arms, each arm having one end pivotal about said pivot axis, and a transverse crossbar interconnecting the respective other ends of said arms for manually pivoting said stirrup against its resilient bias to release said boot member from said ski, wherein said connector pin is mounted on said boot member and said receiver is mounted on said binding member, and wherein said connector pin constitutes said cam means on said boot member; and (g) wherein said binding member includes a rib elongated in the direction of the longitudinal axis of the ski, and a ramp projecting upwardly from said rib and having a front surface inclined relative to the longitudinal axis of said ski, said front surface constituting said cam means on said binding member.

29. A cross-country ski according to claim 28 wherein said receiver is constituted by an upwardly opening notch in said rib.

30. A cross-country ski binding according to claim 28 wherein said receiver includes a notch in at least one of said arms.

31. A cross-country ski binding according to claim 30 wherein the mutual engagement means on said boot member is said connector pin.

32. A cross-country ski binding member for releasably attaching the toe of a boot member to a ski having a longitudinal axis comprising:

(a) cam means on said members cooperable, during downward movement on the boot member relative to the binding member in a direction perpendicular to said axis, for effecting forward displacement of said boot member along said axis relative to the binding member until the sole of said boot member seats on said ski;

(b) a stirrup, mounting means for movably mounting said stirrup on said binding, and bias means for resiliently biasing said stirrup towards a neutral position;

(c) mutual engagement means on said stirrup and on said boot member, said engagement means being constructed and arranged so as to be engageable during cooperation of said cam means for effecting resilient displacement of said stirrup from its neutral position during initial forward displacement of said boot member, for effecting resilient displacement of said stirrup towards its neutral position during final displacement of said boot member, and for retaining said boot member to said ski after the boot member seats on the ski;

(d) a connector pin on one of said members positioned transversely to said axis when said stirrup retains said boot member to said ski; and (e) a receiver on the other said members for pivotably receiving said connector pin and effecting a pivotal connection between the members while said boot member is retained to said ski;

(f) wherein said cam means includes a projection on said binding member having an inclined ramp, wherein said stirrup is mounted on said binding member for pivotal movement about a pivotal axis transverse to the longitudinal axis of the ski, and is biased in a rearward direction along the axis of said ski, wherein said stirrup includes a pair of spaced arms, each arm having one end pivotal about said pivot axis, and a transverse crossbar interconnecting the respective other ends of said arms for manually pivoting said stirrup against its resilient bias to release said boot member and said receiver is mounted on said binding member; and (g) wherein said receiver includes a notch in at least one of said arms.

33. A cross-country ski binding member for releasably attaching the toe of a boot member to a ski having a longitudinal axis comprising:

(a) cam means on said members cooperable, during downward movement of the boot member relative to the binding member in a direction perpendicular to said axis, for effecting forward displacement of said boot member along said axis relative to the binding member until the sole of said boot member seats on said ski;

(b) a stirrup, mounting means for movably mounting said stirrup on said binding, and bias means for resiliently biasing said stirrup towards a neutral position;

(c) mutual engagement means on said stirrup and on said boot member, said engagement means being constructed and arranged so as to be engagable during cooperation of said cam means for effecting resilient displacement of said stirrup from its neutral during initial forward displacement of said boot member, for effecting resilient displacement of said stirrup towards its neutral position during final displacement of said boot member, and for retaining said boot member to said ski after the boot member seats on the ski;

(d) a connector pin on one of said members positioned transversely to said axis when said stirrup retains said boot member to said ski; and (e) a receiver on the other said members for pivotably receiving said connector pin and effecting a pivotal connection between the members while said boot member is retained to said ski;

(f) wherein said stirrup includes a pair of spaced arms, and a transverse cross bar interconnecting said arms for manually moving said stirrup against its resilient bias to release said boot member from said ski;

(g) wherein said connector pin is mounted on said binding member, and said receiver is mounted on said boot member; and (h) wherein said binding member includes a rib located on the longitudinal axis of the ski, said connector pin being mounted in said rib and extending in a direction transverse to the longitudinal axis of the ski, said receiver being a notch in said boot member.

34. A cross-country ski binding member according to claim 33 wherein said boot member includes a pair of laterally spaced legs containing notches for receiving opposite axial ends of said connector pin.

35. A cross-country ski binding member according to claim 34 wherein said stirrup is moveably mounted on opposite axial ends of said connector pin.

* * * * *

UNITED STATES PATENT AND TRADEMARK OFFICE
CERTIFICATE OF CORRECTION

PATENT NO. : 4,949,988

DATED : August 21, 1990

INVENTOR(S) : Didier ROUSSET et al.

It is certified that error appears in the above-identified patent and that said Letters Patent is hereby corrected as shown below:

Column 5, line 38, change "With" to ---with---.

Column 17, line 6 (claim 1, line 33), change "members" to ---member---.

Column 17, line 24 (claim 4, line 5), after "other" insert ---ends of said arms for manually pivoting said stirrup against---.

Column 18, line 52 (claim 17, line 36), after "rearward" insert ---direction---.

Column 20, line 9 (claim 23, line 7), change "effective" to ---effecting---.

Column 20, line 20 (claim 23, line 18), change "effective" to ---effecting---.

Column 21, line 45 (claim 26, line 5), after "one" insert ---end---.

UNITED STATES PATENT AND TRADEMARK OFFICE

CERTIFICATE OF CORRECTION

PATENT NO. : 4,949,988

DATED : August 21, 1990

INVENTOR(S) : Didier Rousset, et al.

It is certified that error appears in the above-identified patent and that said Letters Patent is hereby corrected as shown below:

Column 22, line 49 (claim 32, line 5), change " on" to ---of---.
Column 24, line 6 (claim 33, line 20), after "neutral" insert --- position---.

Signed and Sealed this

Twenty-seventh Day of October, 1992

*Attest:*

DOUGLAS B. COMER

*Attesting Officer*

*Acting Commissioner of Patents and Trademarks*